US011383512B2

(12) United States Patent
Shimazoe

(10) Patent No.: US 11,383,512 B2
(45) Date of Patent: Jul. 12, 2022

(54) INKJET RECORDING DEVICE

(71) Applicant: KONICA MINOLTA, INC., Tokyo (JP)

(72) Inventor: Masanori Shimazoe, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 52 days.

(21) Appl. No.: 16/625,253

(22) PCT Filed: Jun. 12, 2018

(86) PCT No.: PCT/JP2018/022388
§ 371 (c)(1),
(2) Date: Dec. 20, 2019

(87) PCT Pub. No.: WO2018/235673
PCT Pub. Date: Dec. 27, 2018

(65) Prior Publication Data

US 2021/0138784 A1 May 13, 2021

(30) Foreign Application Priority Data

Jun. 21, 2017 (JP) ..... JP2017-121047

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04588; B41J 2/04591; B41J 2/04595; B41J 2/04593; B41J 2/04581
See application file for complete search history.

(56) References Cited

U.S. PATENT DOCUMENTS 7,988,247 B2 * 8/2011 Letendre ..... B41J 2/04593 347/9
8,240,800 B2 * 8/2012 Seto ..... B41J 2/04581 347/10
2013/0083106 A1 * 4/2013 Tsukamoto ..... B41J 2/04596 347/10

FOREIGN PATENT DOCUMENTS

JP 2001162840 A 6/2001
JP 2012045797 A 3/2012
(Continued)

OTHER PUBLICATIONS

PCT IPRP with Written Opinion of the International Searching Authority corresponding to PCT/JP2018/022388; dated Dec. 24, 2019.

(Continued)

*Primary Examiner* — Lam S Nguyen
(74) *Attorney, Agent, or Firm* — Cantor Colburn LLP

(57) ABSTRACT

An inkjet recording device includes a nozzle, a pressure generator and a driver. The nozzle ejects ink. The pressure generator changes pressure on ink in an ink flow path that communicates with the nozzle by a predetermined drive operation. The driver makes the pressure generator perform the drive operation predetermined limes of at least twice at time points on a predetermined cycle, and makes the nozzle eject an ink droplet of an amount corresponding to a number of drive operations included in a set of drive operations. In a case in which the number of drive operations is two, the driver makes the pressure generator perform the drive operation twice with an interval twice as long as the cycle.

6 Claims, 5 Drawing Sheets

(56) References Cited

FOREIGN PATENT DOCUMENTS

| | | | |
|---|---|---|---|
| JP | 2014065149 | A | 4/2014 |
| WO | 2014185142 | A1 | 11/2014 |

OTHER PUBLICATIONS

International Search Report corresponding to Application No. PCT/JP2018/022388; dated Aug. 28, 2018.
CNIPA First Office Action for corresponding CN Application No. 201880041540.0 dated Jul. 31, 2020.
EPO Extended Search Report for corresponding EP Application No. 18820423.4; dated May 12, 2020.
JPO Notice of Reasons for Refusal for corresponding JP Application No. 2019-525451; dated Dec. 14, 2021.

* cited by examiner

INKJET RECORDING DEVICE

CROSS REFERENCE TO RELATED APPLICATIONS

This is the U.S. national stage of application No. PCT/JP2018/022388, filed on Jun. 12, 2018. Priority under 35 U.S.C. § 119(a) and 35 U.S.C. § 365(b) is claimed from Japanese Patent Application No. 2017-121047, filed Jun. 21, 2017; the disclosures of which are incorporated herein by reference.

TECHNOLOGICAL FIELD

The present invention relates to an inkjet recording device.

BACKGROUND ART

Conventionally, there is an inkjet recording device that records an image or the like by ejecting ink from a nozzle and landing it on a medium. In an inkjet recording device, shades are usually expressed in accordance with the area covered with ink per unit area. As one method for controlling the area covered with ink, a method of changing the ink amount per drop is known.

As a technology to appropriately change the ink amount per drop, there is a technique of obtaining a single droplet having a liquid amount corresponding to the number of original droplets by adjusting ejection timing, speed, etc. of droplets ejected by continuously performing ejection operation several times to integrate them with each other before landing on the medium (for example, Patent Document 1).

PRIOR ART DOCUMENT

Patent Document

Patent Document 1: JP 2012-45797 A

SUMMARY OF THE INVENTION

Problems to be Solved by the Invention

However, if the ejection operation is continued, unnecessary micro droplets (satellites) are likely to be generated due to influence of previous ejection operation. These micro droplets land on a medium to cause a problem of reduced quality of recording.

An object of the present invention is to provide an inkjet recording device capable of recording with more stable quality.

In order to achieve the above object, the invention includes:

a nozzle that ejects ink;

a pressure generator that changes pressure on ink in an ink flow path that communicates with the nozzle by a predetermined drive operation; and a driver that operates the pressure generator, wherein the driver makes the pressure generator perform the drive operation predetermined times of at least twice at time points on a predetermined cycle, and makes the nozzle eject an ink droplet of an amount corresponding to a number of drive operations included in a set of drive operations, and in a case in which the number of drive operations is two, the driver makes the pressure generator perform the drive operation twice with an interval twice as long as the cycle.

In an embodiment, in a case in which the number of drive operations is three or more, the driver makes the pressure generator perform the drive operation on the cycle.

In an embodiment, the driver determines a time point of a last drive operation in the set of drive operations in accordance with a time point of ink ejection.

In an embodiment, a period of the cycle has a same length as a natural vibration period of ink in the ink flow path.

In an embodiment, the drive operation includes a first operation of increasing a volume of the ink flow path and a second operation of reducing the increased volume, and in a last drive operation in the set of drive operations, a period between a start time point of the first operation and a start time point of the second operation is determined in accordance with a delay time related to displacement of ink in the ink flow path in response to the drive operation.

In an embodiment, the delay time is 0.55 to 0.70 times as long as a natural vibration period of ink in the ink flow path.

In an embodiment, the driver makes the pressure generator perform a predetermined suppression operation of suppressing change in pressure on ink in the ink flow path after the set of drive operations is performed.

Advantageous Effects of Invention

The present invention achieves effect that an inkjet recording device performs recording with more stable quality.

MEANS FOR SOLVING PROBLEMS

Hereinafter, embodiments of the present invention will be described with reference to the drawings.

Figure 1:
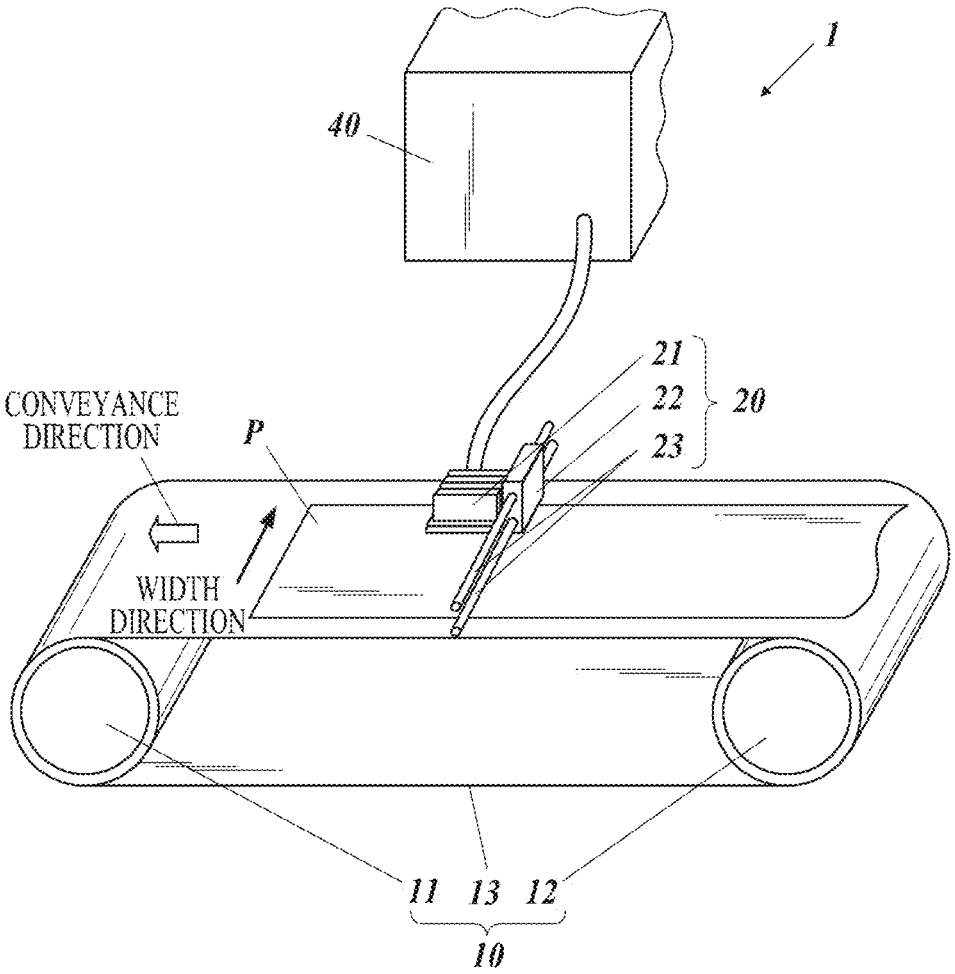
FIG. 1 is a perspective view that schematically shows a schematic configuration of an inkjet recording device of an embodiment.

FIG. 1 is a perspective view schematically showing a schematic configuration of an inkjet recording device 1 of the present embodiment.

The inkjet recording device 1 includes a conveyor 10, a recorder 20, a controller 40, and the like. The conveyor 10 conveys a recording medium P at a predetermined speed. The conveyor 10 includes a driving roller 11, a driven roller 12, a conveyance belt 13, and the like.

The conveyance belt 13 is an endless belt that is stretched between the driving roller 11 and the driven roller 12, and circulates between the driving roller 11 and the driven roller 12. The recording medium P is placed on the outer peripheral surface of the conveyance belt 13 on the side not in contact with the driving roller 11 and the driven roller 12. In the embodiment, the recording medium P is in the range of a plane facing an ink ejection surface of a recording head 21, and moves in accordance with the circular movement.

The driving roller 11 is rotated by a rotation motor (not shown). In accordance with this rotation, the conveyance belt 13 circulates.

The driven roller 12 rotates in accordance with the circular movement of the conveyance belt 13.

The recorder 20 includes a recording head 21, a carriage 22, a carriage rail 23, and the like.

The recording head 21 ejects ink to land it on the recording medium P. Although not particularly limited, four recording heads 21 that respectively eject CMYK (cyan, magenta, yellow, and black) four colors of ink are provided. These four recording heads 21 are arranged in the width direction, which is perpendicular to the conveyance direction of the recording medium P, and are attached to the carriage 22. The surface of the recording head 21 that faces the recording medium P is the ink ejection surface in which openings (nozzle openings) of nozzles 212 (see FIG. 2 and FIG. 4A) are arranged. Ink is ejected from the nozzle opening in a direction substantially perpendicular to the recording medium P, and lands on the recording medium P.

The recording head 21 according to the present embodiment includes nozzles 212 that eject ink, an ink flow path 213 (see FIG. 4A) that includes pressure chambers respectively communicating with the nozzles, an actuator 211 (pressure generator; see FIG. 2 and FIG. 4A) that changes pressure on ink in the ink flow path by deforming the pressure chambers respectively, and the like. The actuator 211 is deformed in a direction in which the pressure chamber is expanded by applying a (negative) voltage lower than a reference voltage (increase in volume; first operation), and draws ink inward. When the applied voltage returns from the negative voltage to the reference voltage, the pressure chamber returns from the deformed state to reduce the volume of the pressure chamber (second operation). Thereby ink is pushed out and is ejected from the nozzle 212.

More than one recording head 21 may be provided for each color. In addition, head units in which the recording heads 21 are arranged and fixed in a predetermined pattern may be formed, and each of the head units may be fixed to the carriage 22.

The carriage 22 moves in the width direction along the carriage rail 23 while holding the recording head 21. The portion of the carriage 22 on which the recording head 21 is placed and fixed is provided between a conveyance surface (recording medium P) of the conveyance belt 13 and the ink ejection surface of the recording head 21. A gap is provided between the ink ejection surface of the recording head 21 and the recording medium P so that ink ejected from the nozzles passes through the gap. A portion of the carriage 22 which is fixed to the carriage rail 23 is provided at one end on the conveyance direction side, and two carriage rails 23 penetrate the inside.

Two carriage rails 23 are provided in a range equal to or larger than the maximum recordable width of the recording medium P, the carriage rails 23 being parallel to a direction perpendicular to the conveyance direction, which is the width direction in the embodiment. The carriage rails 23 support the carriage 22 such that the carriage 22 is movable in the width direction. The carriage 22 can be moved by any means, for example, a linear motor. The position of the carriage 22 along the carriage rail 23 (position in the scanning direction) is detected by a linear encoder (not shown) or the like, and the detection result is output to the controller 40.

The controller 40 controls timing of conveyance of the recording medium P by the conveyance unit 10, movement (scanning) of the recording head 21 in the width direction, and ink ejection operation, to control the image recording operation on the recording medium P. That is, in the inkjet recording device 1, a two-dimensional image is formed by combining scan operation of moving the recording head 21 in the width direction and conveyance operation of moving the recording medium P in the conveyance direction.

Figure 2:
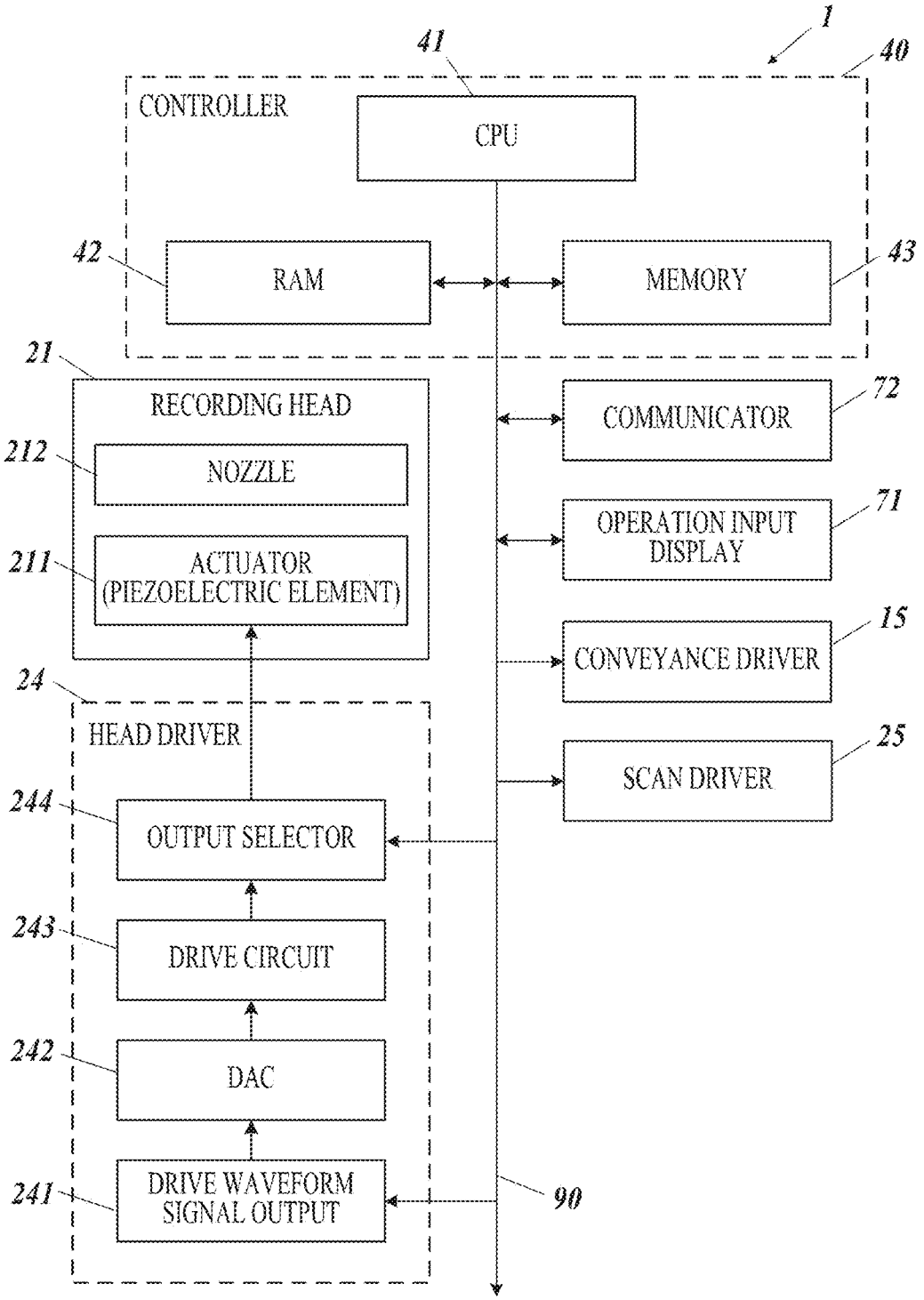
FIG. 2 is a block diagram that shows a function structure of an inkjet recording device.

FIG. 2 is a block diagram showing a functional configuration of the inkjet recording device 1 of the embodiment.

The inkjet recording device 1 includes the above-described recording head 21, the controller 40, a conveyance driver 15, a head driver 24 (driver), a scan driver 25, an operation input display 71, a communicator 72, a bus 90, and the like.

The head driver 24 operates the actuator 211 by outputting a drive voltage signal for ejecting ink from each nozzle of the recording head 21 at appropriate timing to the actuator 211 corresponding to the selected nozzle 212. The head driver 24 includes a drive waveform signal output 241, a digital/analog converter 242 (DAC), a drive circuit 243, an output selector 244, and the like.

The drive waveform signal output 241 outputs digital data of a drive waveform corresponding to ink ejection or non-ejection (including interruption or termination of image recording) in synchronization with a clock signal input from an oscillation circuit (not shown). The DAC 242 converts the drive waveform of this digital data into an analog signal and outputs it to the drive circuit 243 as an input signal Vin.

The drive circuit 243 amplifies the input signal Vin to a voltage value corresponding to a drive voltage of the actuator 211, and further outputs an output signal Vout obtained by performing current amplification in accordance with a current flowing to the actuator 211 (electrodes at both ends).

The output selector 244 outputs a switching signal for selecting the actuator 211 to which the output signal Vout is output in accordance with pixel data of an image to be formed which is input from the controller 40.

In the recording head 21, the actuator 211 is deformed by a driving voltage signal from the drive circuit 243 of the head driver 24, and ink is ejected from the nozzles 212 in accordance with the deformation. Ink droplets are landed on a position on the recording medium which corresponds to operation of the conveyance driver 15 and the scan driver 25. A piezoelectric element is used as the actuator 211. This piezoelectric element is provided along an ink flow path 213 (pressure chamber; see FIG. 4A) to each nozzle 212. When voltage of the drive voltage signal output from the drive circuit 243 is applied, the piezoelectric element deforms so that the volume of the ink flow path 213 is increased (the first operation described above) and reduced (including a case in which the volume just returns to the value before it is increased) (the second operation described above). This changes pressure on ink in the ink flow path 213. In accordance with this pressure change pattern, ink having an appropriate amount, speed, and droplet shape is ejected from the nozzle opening. The deformation mode of the actuator 211 (piezoelectric element) is not particularly limited.

The conveyance driver 15 receives the recording medium P from a medium supply unit before image recording, and arranges the recording medium P so that an appropriate position faces the ink ejection surface of the recording head 21. The recording medium P on which an image is recorded is discharged from a position facing the ink ejection surface. The conveyance driver 15 rotates the motor that rotates the driving roller 11 as described above at an appropriate speed and timing.

The scan driver 25 moves the carriage 22 (recording head 21) to an appropriate position along the width direction. For example, the scan driver 25 rotates the motor that rotates the above-described endless belt at an appropriate timing and speed.

The operation input display 71 displays status information and a menu related to image recording and receives operation input by a user. The operation input display 71 includes, for example, a display screen of a liquid crystal panel, a driver for the liquid crystal panel, a touch panel piled on the liquid crystal screen, and the like. An operation detection signal corresponding to a position of touch operation by a user and to a kind of the operation is output to the controller 40. The operation input display 71 may further be provided with an LED (Light Emitting Diode) lamp, a push button switch, and the like, and is used for warning indication or for indication and operation of main power, for example.

The communicator 72 transmits/receives data to/from external devices by a predetermined communication standard. As the communication standard, various known methods, such as TCP/IP connection related to communication using a LAN (Local Area Network) cable, wireless LAN (IEEE802.11), short-range wireless communication (IEEE802.15) such as Bluetooth (registered trademark), and USB (Universal Serial Bus), can be used. The communicator 72 includes a connection terminal according to a usable communication standard, a driver hardware (network card) related to connection of communication, and the like.

The controller 40 controls the overall operation of the inkjet recording device 1. The controller 40 includes a CPU 41 (Central Processing Unit), a RAM 42 (Random Access Memory), a memory 43, and the like. The CPU 41 performs various arithmetic processes related to overall control of the inkjet recording device 1. The RAM 42 provides a working memory space to the CPU 41 and stores temporary data. The memory 43 stores a control program executed by the CPU 41, setting data, and the like, and temporarily stores image data to be formed. The memory 43 includes a volatile memory such as a DRAM and a non-volatile storage medium such as an HDD (Hard Disk Drive) or a flash memory, and is used for different purposes.

The bus 90 is a communication path that connects these components to transmit and receive data.

In the embodiment, the inkjet recording device 1 of a scan type in which the recording head 21 performs scanning is described as an example. However, a line head may be used as the recording head 21. In that case, a two-dimensional image is recorded by moving the recording medium P only in a conveyance direction while the recording head 21 is fixed. Further, the conveyance of the recording medium P is not limited to that performed by an endless belt. Any kind of inkjet recording device can be used as long as it records an image by ejecting ink.

Ink ejection operation in the inkjet recording device 1 of the embodiment will be described.

In the inkjet recording device 1, the head driver 24 makes the actuator 211 perform drive operation of deforming to expand (increase the volume) the ink flow path 213 (pressure chamber) and to restore the expansion. Thus ink is ejected. In the embodiment, the voltage is decreased and kept at a level lower than the reference voltage. Then a drive waveform voltage that raise the voltage to the original reference voltage is applied.

Figure 3:
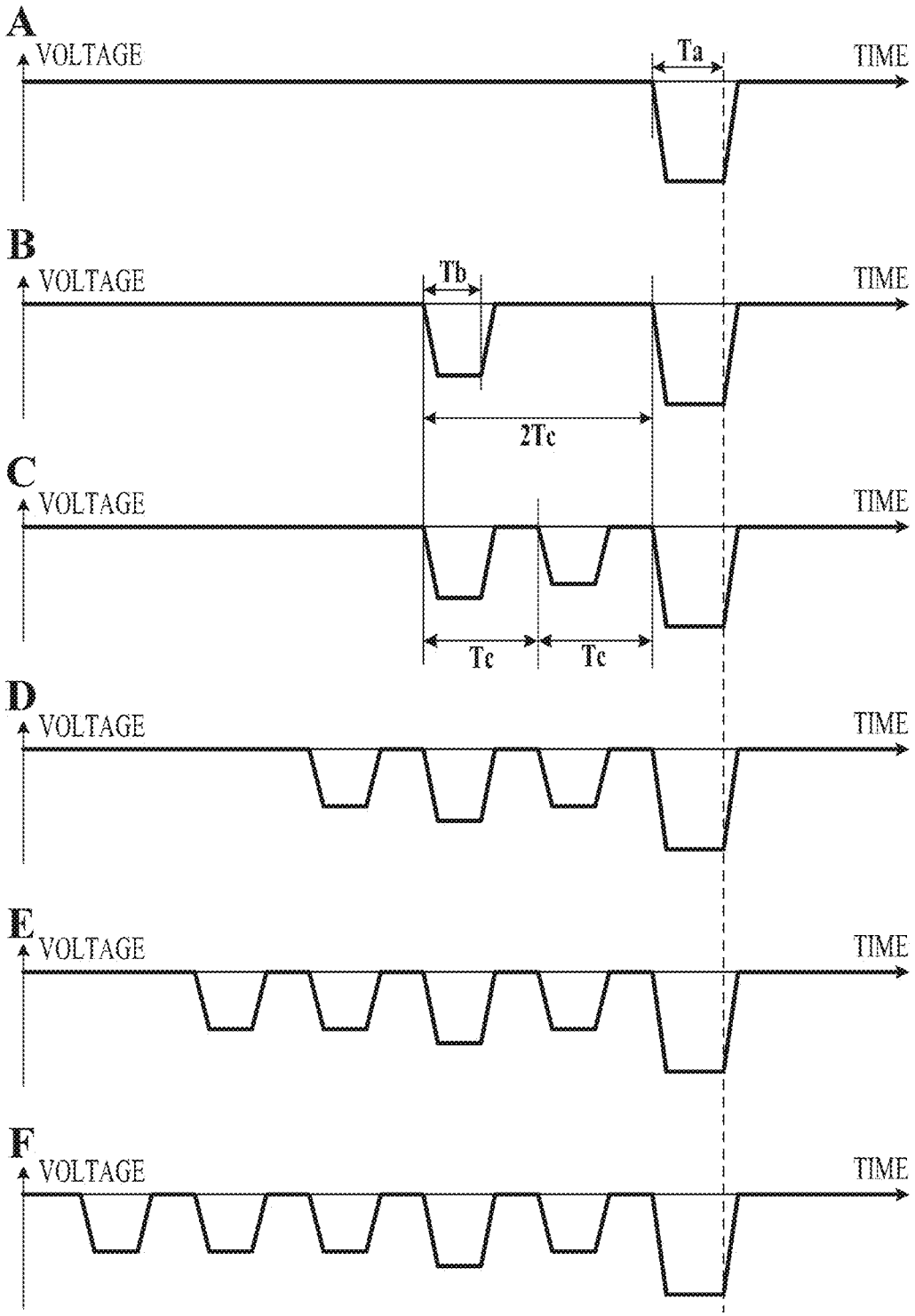
FIG. 3 is a figure that explains a pattern of voltage applied to an actuator.

FIG. 3 is a diagram explaining a pattern of voltage applied to the actuator 211 (piezoelectric element) in the inkjet recording device 1 of the embodiment.

In the inkjet recording device 1, a multi-gradation ejection operation that ejects a liquid amount several times (predetermined times of at least twice) as large as a unit ejection amount corresponding to one normal drop is possible. In this embodiment, the liquid amount can be, at the maximum, six times as large as the unit ejection amount. In the inkjet recording device 1, a set of drive operations of applying a predetermined drive waveform voltage several times at time points on a predetermined cycle (not necessarily a completely continuous cycle as described later). Thereby ink masses in which extruded ink is continuous without being separated from ink in the ink flow path are formed. Then, after they are separated from ink in the ink flow path, the ink masses are integrated with each other, and a single ink droplet having a total liquid amount (a liquid amount corresponding to the number of times the drive operation is performed) lands on the recording medium. The period of the cycle is determined to be in an appropriate range such that ink masses ejected from the nozzle openings are generated, separated, and then integrated as an ink droplet in the end as described above. In this embodiment, it is set at the same length as the natural vibration period Tc of ink in the ink flow path 213 (see FIG. 4A).

The amplitude of each drive waveform voltage is adjusted so that the speed of ink droplets after integration of ink masses is the same regardless of an amount of each ink droplet, in other words, the number of times the drive waveform voltage is applied to the actuator 211. The time point of applying the final drive waveform voltage (operation time point of drive operation) is defined with respect to (determined in accordance with) an ink ejection time point, that is, a time point of ink landing on the recording medium P. In a case in which the liquid amount of an ink droplet is predetermined times of at least twice as large as the unit ejection amount, the drive waveform voltage signal is added before the last drive waveform voltage signal, and the drive waveform voltage is applied to the actuator 211 predetermined times in total. The predetermined times is not limited to a strict value and may include an error as long as it does not cause a problem in the density of image due to ejected ink.

As described above, in the embodiment, it is possible to eject ink droplets of six levels of liquid amount. As a time during which the drive operation can be performed in accordance with this, a period of six cycles (a time during which the drive operation can be performed predetermined times of at least twice) are secured in advance for each ejection operation of a ink droplet. As a result, it is possible to perform the ink ejection operation on a uniform cycle corresponding to the period of six cycles. The head driver 24 switches presence/absence of the drive operation at each time point in six cycles at the output selector 244 in accordance with tone data input from the memory 43 for each pixel position. Thereby a corresponding amount of ink is ejected and landed on the pixel position.

In a case in which the drive waveform voltage is applied twice to the actuator 211 to eject and land a liquid amount twice as large as the unit ejection amount, that is, the operation is performed twice, the head driver 24 is made to perform the drive operation of outputting the first drive waveform voltage signal a period of two cycles (a time twice as large as the period of the cycle) before the last output time point of the drive waveform voltage signal (B in FIG. 3). In a case in which the drive waveform voltage is applied to the actuator 211 predetermined times of at least three times, that is, the operation is performed three or more times, the head driver 24 is made to perform the drive operation of outputting the drive waveform voltage signal predetermined times on the cycle including the last output time point of the drive waveform voltage signal (C to F in FIG. 3). In a case in which the operation is performed once, the head driver 24 is made to perform the drive operation of outputting the drive waveform voltage signal at the last output time point of the drive waveform voltage signal (A in FIG. 3).

FIGS. 4A to FIG. 4G are diagrams schematically showing the ink liquid surface in the vicinity of the nozzle opening when ink is ejected. The relationship between the size of the ink mass or ink droplet and the size of the ink liquid column in these drawings do not accurately reflect the actual ratio for convenience of explanation.

Figure 4A:
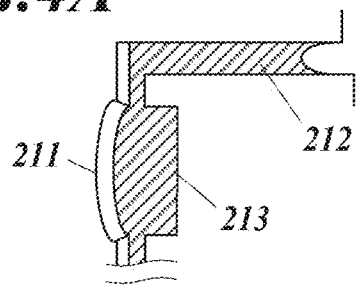
FIG. 4A is a figure that schematically shows an ink liquid surface in the vicinity of a nozzle opening when ink is ejected.
Figure 4B:
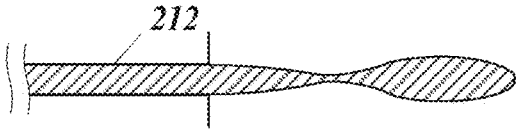
FIG. 4B is a figure that schematically shows the ink liquid surface in the vicinity of the nozzle opening when ink is ejected.
Figure 4C:
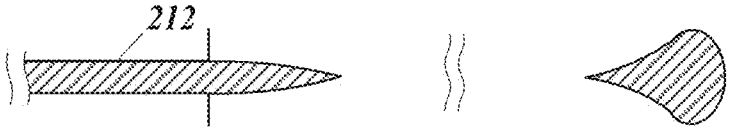
FIG. 4C is a figure that schematically shows the ink liquid surface in the vicinity of the nozzle opening when ink is ejected.

As shown in FIG. 4A, with the first voltage drop in the drive waveform voltage, the actuator 211 is deformed, the ink flow path 213 (pressure chamber) expands, and the ink liquid surface (meniscus surface) inside the nozzle 212 is drawn inward from the nozzle opening. With the subsequent voltage increase (recovery to the original voltage), the ink liquid surface inside the nozzle 212 jumps out of the nozzle opening as shown in FIG. 4B. At this time, the ink that jumps out of the opening of the nozzle 212 becomes an ink mass that is not separated but is connected to ink in the nozzle 212 as an ink liquid column. When the drive waveform voltage is applied once as shown in A of FIG. 3, one ink mass corresponding to the drive waveform voltage is separated from ink in the nozzle 212 and becomes an ink droplet a period of approximately three cycles after the output start time point of one drive waveform voltage signal (FIG. 4C).

Figure 4D:
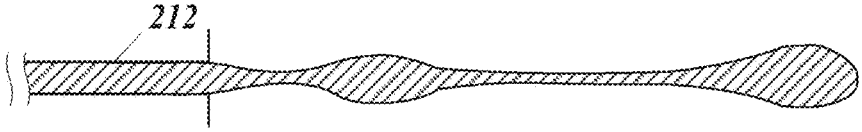
FIG. 4D is a figure that schematically shows the ink liquid surface in the vicinity of the nozzle opening when ink is ejected.
Figure 4E:
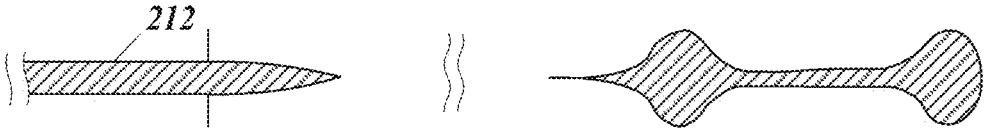
FIG. 4E is a figure that schematically shows the ink liquid surface in the vicinity of the nozzle opening when ink is ejected.
Figure 4F:
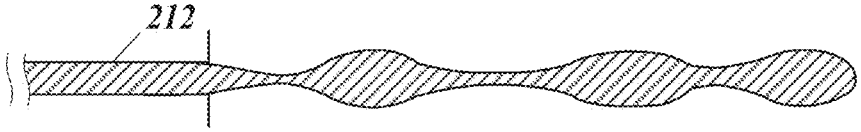
FIG. 4F is a figure that schematically shows the ink liquid surface in the vicinity of the nozzle opening when ink is ejected.

In a case in which an ink droplet of an amount twice as large as the unit ejection amount is ejected, the second drive waveform voltage signal is input to the actuator 211 a period of two cycles after the start of output of the first drive waveform voltage signal as shown in B of FIG. 3. Along with this, an ink liquid column in which two ink masses line up with a space therebetween is generated from the opening of the nozzle 212 (FIG. 4D). The two ink masses are separated from ink in the nozzle 212, and an ink droplet of the amount twice as large as the unit ejection amount is discharged (FIG. 4E). The separated ink masses combine (integrate) with each other more completely due to viscosity (surface tension) or the like, jump, and land on the recording medium P. After the ink droplet is separated from the ink liquid column, the base portion of the ink liquid column is pulled back into the nozzle 212 in accordance with the viscosity of ink (pulling force into the nozzle 212 due to reverberation vibration).

During this action, reverberation vibration is superimposed on the vibration associated with the last (second) drive waveform voltage signal. The larger the amplitude of the reverberation vibration, the higher the speed of the ink mass that jumps out of the nozzle opening at the last (second time). The likelihood of generation of satellites depends on the ejection speed of the last ink mass, in other words, the length of a tail of the ink mass before it is separated from ink in the nozzle 212. In the present embodiment in which the drive waveform voltage signal output at the time point after the period of two cycles is input to the actuator 211, the reverberation vibration is attenuated in accordance with the interval of one cycle. Therefore, generation of satellites is suppressed in accordance with the attenuation of reverberation vibration.

Figure 4G:
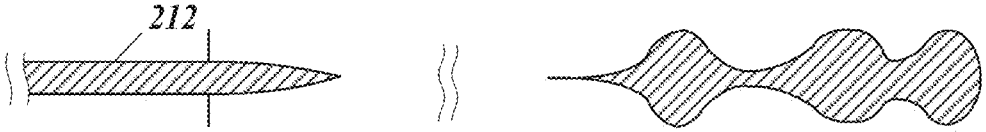
FIG. 4G is a figure that schematically shows the ink liquid surface in the vicinity of the nozzle opening when ink is ejected.

In a case in which an ink droplet of an amount three times as large as the unit ejection amount are ejected, the drive waveform voltage signal is input to the actuator 211 three times in three continuous cycles as shown in C of FIG. 3. Along with this, an ink liquid column in which three ink masses line up is generated from the opening of the nozzle 212 (FIG. 4F), and then separated from ink in the nozzle 212. Thus an ink droplet of a liquid amount three times as large as the unit ejection amount is ejected (FIG. 4G).

In the case in which an ink droplet of the amount three times as large as the unit ejection amount is ejected, the liquid amount of the last ink mass (that is, the unit ejection amount) is smaller in ratio as compared with the total liquid amount of the preceding ink masses. As a result, the last ink mass is more effectively attracted to the preceding ink masses as compared with the case in which an ink droplet of the amount twice as large as the unit ejection amount is ejected as described above. On the other hand, since the vibration of ink in the nozzle 212 also increases, the force in the drawing direction into the nozzle 212 also increases. Therefore, even if the speed of the last ink mass somewhat increases, an ink droplet only is likely to be separated without generating satellites.

In a case in which an ink droplet of an amount four or more times as large as the unit ejection amount is ejected, the total liquid amount of the preceding ink masses further increases, so that generation of satellites is more effectively suppressed.

In a case in which an ink droplet of an amount at least twice as large as the unit ejection amount is ejected, the drive waveform voltage signal other than the last drive waveform voltage signal has a period Ta2 from the start of voltage fall to the start of voltage rise which is half the natural vibration period Tc, that is, Tc/2. In the last drive waveform voltage signal (last drive operation), the time Ta1 from the voltage fall start (first operation start time point) to the rise start (second operation start time point) is 0.55 to 0.70 Tc, which is longer than a half of the natural vibration period Tc. In other words, it is 1.1 to 1.4 times as long as the acoustic length AL, which indicates the propagation time relating to vibration of a liquid surface and which is half of the natural vibration period Tc. This means that the start of voltage rise is delayed by a length (delay time) corresponding to phase delay of actual vibration (displacement) of ink with respect to an application time point of the drive waveform voltage (drive operation). That is, regarding the last drive waveform voltage signal, the time length from the start of voltage fall to the start of voltage rise is adjusted so that only the time point of the last push-out of ink matches the actual phase of ink vibration more completely.

Modification

A modification of the voltage signal which is output when the actuator 211 is driven in the inkjet recording device 1 of the above embodiment will be described.

Figure 5:
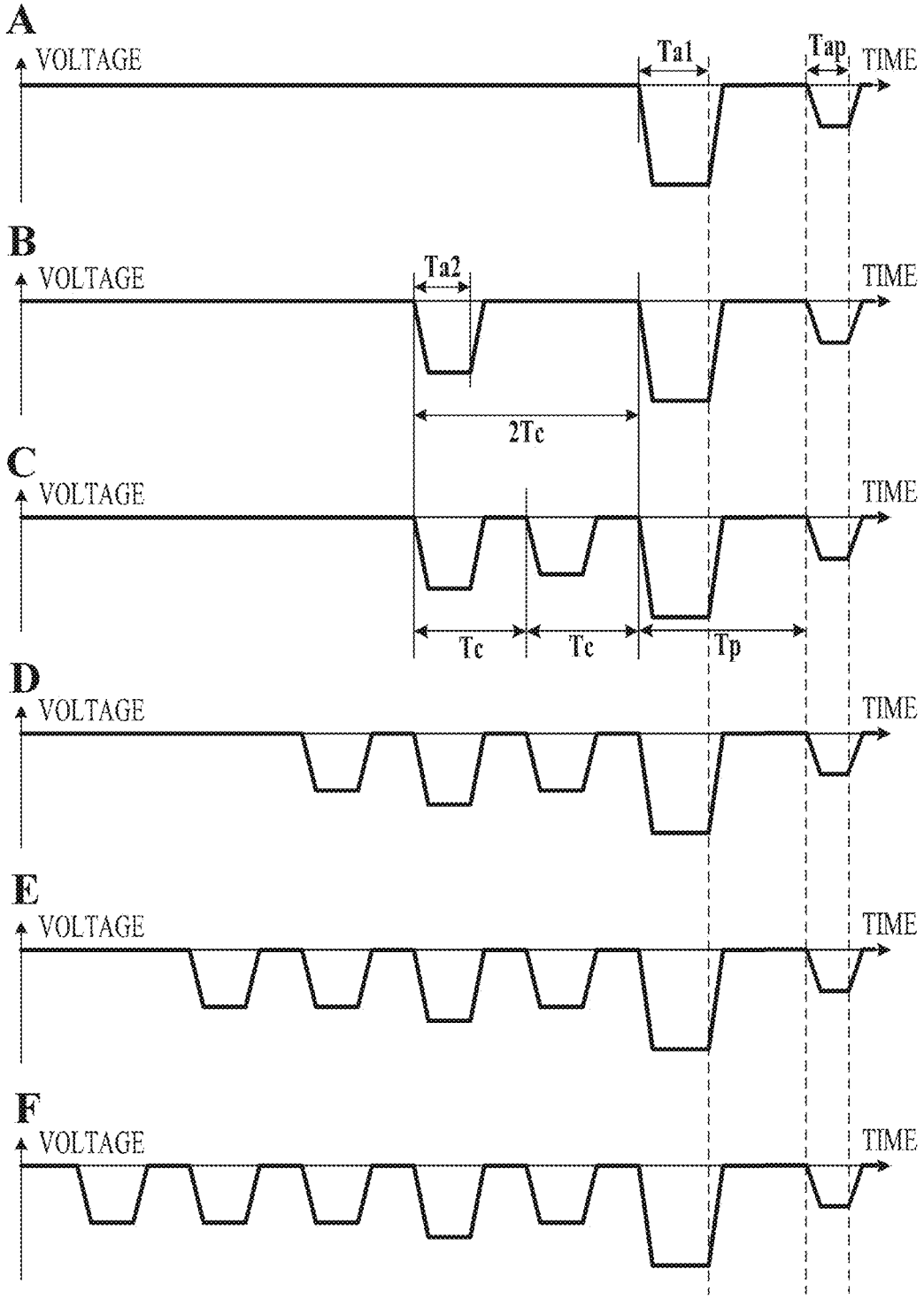
FIG. 5 is a figure that shows a modification of the pattern of voltage applied to the actuator.

FIG. 5 is a diagram illustrating a modified example of a pattern of voltage applied to the actuator 211.

In each of the drive waveform voltage patterns of the modification shown in A to F of FIG. 5, after the last drive waveform voltage signal is output by the head driver 24 in each of the drive waveform voltage patterns A to F in FIG. 3, a suppression waveform voltage signal for reverberation vibration is output. Thereby the actuator 211 performs suppression operation of making the ink flow path 213 (pressure chamber) deform to suppress reverberation vibration. Except for this, they are the same.

The suppression waveform voltage signal is used to quickly attenuate reverberation vibration remaining in ink in the ink flow path 213 after the last drive waveform voltage is applied. Therefore, the amplitude of the suppression waveform voltage is determined to be small enough not to newly eject ink (no ink droplets are generated), and the phase is opposite or nearly opposite to the phase of reverberation vibration of ink. The time from the voltage fall to the voltage rise of the suppression waveform voltage is set to the shortest time between the time points at which the voltage fall and the voltage rise are respectively in phases for suppressing reverberation vibration.

As described above, the inkjet recording device 1 of the embodiment includes:

the nozzle 212 that ejects ink;

the actuator 211 that changes pressure on ink in the ink flow path 213 including the pressure chamber that communicates with the nozzle 212 by the predetermined drive operation; and the head driver 24 that operates the actuator 211.

The head driver 24 makes the actuator 211 perform the drive operation predetermined times of at least twice at time points on a predetermined cycle. In this embodiment, the drive operation can be performed six times at the maximum. The head driver 24 ejects an ink droplet of an amount corresponding to the number of drive operations included in a set of drive operations. In the case in which the number of operations is two, the drive operation is performed twice with an interval twice as long as the cycle.

In this way, in the case in which ink masses are ejected from the nozzles 212 by performing the drive operation several times and are integrated with each other so that an ink droplet of an amount corresponding to the number of times the drive operation is performed is ejected, reverberation vibration related to previous drive operations is superimposed on the second and subsequent drive operations. Particularly in the case in which the drive operation is performed twice, reverberation vibration is attenuated by increasing the interval between the first drive operation and the second drive operation by one cycle. Thereby the injection speed of ink mass related to the second drive operation is reduced, and generation of satellites is suppressed. As a result, in the inkjet recording device 1, deterioration of recording quality due to generation of satellites is reduced.

In the case in which the drive operation is performed predetermined times of at least three times, the head driver 24 makes the actuator 211 perform the drive operation predetermined times on the cycle. The increase in the ejection speed of the last ink mass due to superposition of reverberation vibration as described above may occur also in the case in which the drive operation is performed three or more times. As the ink volume of the preceding ink mass increases, the last ink mass is more effectively integrated with the preceding ink masses and satellites are less likely to be generated. Therefore, in the case in which the drive operation is performed three or more times in the inkjet recording device 1, it is possible to prevent decrease in ink discharge frequency, that is, to suppress a decrease in image recording speed, by keeping intervals between the drive operations within a minimum necessary length.

The head driver 24 determines the operation time point of the last drive operation in a set of drive operations in accordance with a time point of ink ejection. By making ink droplets jump in the same speed and determining time points of the drive operations such that the ink droplets are ejected at standard time points in accordance with the speed, the ink droplets are easily landed on appropriate positions on the recording medium P. Thereby the inkjet recording device 1 maintains recording quality appropriately.

Further, the period of the cycle is set equal to the period of the natural vibration cycle Tc of ink in the ink flow path 213. Thus, in the inkjet recording device 1 of the invention, recording quality is maintained and improved by appropriately and easily controlling influence of reverberation vibration and suppressing generation of satellites.

The drive operation includes the first operation of increasing the volume of the ink flow path and the second operation of reducing the increased volume. In the last drive operation in a set of drive operations, the period between the start time point of the first operation and the start time point of the second operation is defined with respect to a delay time related to displacement of ink in the ink flow path 213 in response to the drive operation. In this way, by matching the time point of pushing ink out in the last drive operation with the time point of displacement operation of ink, the inkjet recording device 1 more effectively gives momentum to ink so that ink masses separate from an ink liquid column, jump and land on the recording medium P.

The delay time is 0.55 to 0.70 times as long as the natural vibration period Tc of ink in the ink flow path 213, that is, 1.1 to 1.4 times as long as AL. The delay time depends on the viscosity of ink, the size of a nozzle, and the like. By appropriately determining the delay time in a range in accordance with the viscosity and the size of a nozzle such that an ink droplet made by integration of ink masses is properly ejected, the inkjet recording device 1 more effectively gives momentum to ink so that ink masses separate from an ink liquid column, jump and land on the recording medium P.

The head driver 24 causes the actuator 211 to perform predetermined suppression operation that suppresses change in the pressure on ink in the ink flow path 213 after a set of drive operations is performed. That is, the head driver 24 outputs the suppression waveform voltage signal after the drive waveform voltage signal. As a result, after all the ink masses are ejected from the nozzle openings, unnecessary ink is not ejected from the nozzle openings by reverberation vibration. Thereby a cause of satellites is reduced. Further, since reverberation vibration is effectively attenuated before start of the drive operation for ejection of the next ink droplet, the influence of reverberation vibration does not remain in ejection of other ink droplets.

The present invention is not limited to the above-described embodiment, and various modifications can be made.

For example, in the above embodiment, in the case in which an ink droplet of the amount three or more times as large as the unit ejection amount, the drive operation is continuously performed several times on the cycle, the several times corresponding to the amount of the ink droplet, which is several times as large as the unit ejection amount. However, in the range of the maximum time (in this embodiment, six cycles) set for operation of ejecting one ink droplet, a period in which the drive operation is not performed may be inserted in the middle, preferably before ejection of the last ink mass. As a result, reverberation vibration superimposed on the last drive operation is suppressed as in the case in which an ink droplet of the amount twice as large as the unit ejection amount is ejected.

In the above embodiment, the time point of the drive operation for the last ink mass is determined in accordance with the time point of ink ejection on the assumption that ink droplets are ejected at the same speed regardless of the ink amount. However, time points of drive operations may be determined so as to shift the time point of ejection in accordance with the speed of each ink droplet.

In the above embodiment, the cycle is set in accordance with the natural vibration period of ink in the ink flow path. However, each ink mass may be ejected from the nozzle opening at an appropriate speed with an appropriate liquid amount, and all the ink masses may be deviated from the natural vibration period as long as they can be ejected together as a single ink droplet.

In the above embodiment, the drive waveform voltage signal forms a trapezoidal shape in which a falling edge and a rising edge are symmetrical and change linearly, the falling edge representing change to negative voltage which increases the volume of the ink flow path 213 (pressure chamber), and the rising edge representing change to the reference voltage from the negative voltage which recovers the reduced volume of the ink flow path 213. However, this is just an example, and the drive waveform is not limited to this. As long as the drive waveform appropriately changes pressure on ink in the ink flow path 213 (pressure chamber) to eject ink droplets of various amounts, the falling edge and the rising edge of voltage can be asymmetrical, and the voltage change can be non-linear.

In the above embodiment, the voltage rise time point for the last drive operation is set at a time point outside the range from the voltage fall time point to the voltage rise time point for other drive operations. However, it may be set within the range.

In the above embodiment, an ink droplet of an amount six times as large as the unit ejection amount at the maximum is ejected. However, the present invention can be applied to any case in which the maximum amount of an ink droplet is twice or more as large as a unit ejection amount.

In the above embodiment, the head driver 24 switches presence/absence of the drive operation in each cycle according to tone data for pixel positions of image data to be recorded. However, CPU 41 or the like may perform control operation of switching presence/absence of the drive operation in accordance with the tone data.

In the above embodiment, a piezoelectric element is used as an example of the actuator 211. However, the present invention is not limited to this, and it may be any configuration that converts electricity, magnetism, heat or the like into change in shape as long as it changes pressure on ink in the ink flow path 213 (pressure chamber).

In the above embodiment, ink of CMYK four colors for image recording is described as an example. However, ink for ejection may be transparent ink for coating (covering) an image, or various kinds of inks (liquids) for recording which coagulate in appropriate shapes after landing.

In addition, specific details such as the configuration, operation content, and operation procedure described in the above embodiment can be changed as appropriate without departing from the scope of the present invention.

INDUSTRIAL APPLICABILITY

The present invention can be applied to inkjet recording devices.

REFERENCE SIGNS LIST

1 inkjet recording device
10 conveyor
11 driving roller
12 driven roller
13 conveyance belt
15 conveyance driver
20 recorder
21 recording head
211 actuator
212 nozzle
213 ink flow path
22 carriage
23 carriage rail
24 head driver
241 drive waveform signal output
242 analog converter
243 drive circuit
244 output selector
25 scan driver
40 controller
41 CPU
42 RAM
43 memory
71 operation input display
72 communicator
90 bus

The invention claimed is:

1. An inkjet recording device comprising:

a nozzle that ejects ink;

a pressure generator that changes pressure on ink in an ink flow path that communicates with the nozzle by a predetermined drive operation; and a driver that operates the pressure generator, wherein the driver makes the pressure generator perform the drive operation predetermined times of at least twice at time points on a predetermined plurality of cycles, each cycle of the plurality of cycles having an equal predetermined time length, and makes the nozzle eject an ink droplet of an amount corresponding to a number of drive operations included in a set of drive operations after the passage of the plurality of cycles, and in a case in which the number of drive operations is two, the driver makes the pressure generator perform the drive operation twice with a time interval between drive operations twice as long as the time length of the cycle;

wherein the drive operation includes a first operation of increasing a volume of the ink flow path and a second operation of reducing the increased volume, and in a last drive operation in the set of drive operations, a period between a start time point of the first operation and a start time point of the second operation is determined in accordance with a delay time related to displacement of ink in the ink flow path in response to the drive operation.

2. The inkjet recording device according to claim 1, wherein, in a case in which the number of drive operations is three or more, the driver makes the pressure generator perform the drive operation on the cycle.

3. The inkjet recording device according to claim 1, wherein the driver determines a time point of the last drive operation in the set of drive operations in accordance with a time point of ink ejection.

4. The inkjet recording device according to claim 1, wherein a period of the cycle has a same length as a natural vibration period of ink in the ink flow path.

5. The inkjet recording device according to claim 1, wherein the delay time is 0.55 to 0.70 times as long as a natural vibration period of ink in the ink flow path.

6. The inkjet recording device according to claim 1, wherein the driver makes the pressure generator perform a predetermined suppression operation of suppressing change in pressure on ink in the ink flow path after the set of drive operations is performed.

* * * * *